United States Patent [19]

Dexter, Jr.

[11] Patent Number: 4,828,099

[45] Date of Patent: May 9, 1989

[54] FRICTION-PROPELLED MASS TRANSIT SYSTEM

[76] Inventor: Fred F. Dexter, Jr., 2311 South Blvd., Houston, Tex. 77098

[21] Appl. No.: 893,741

[22] Filed: Aug. 6, 1986

Related U.S. Application Data

[63] Continuation-in-part of Ser. No. 661,427, Oct. 18, 1984, abandoned.

[51] Int. Cl.[4] ..... B65G 15/00

[52] U.S. Cl. ..... 198/324; 104/21; 104/25

[58] Field of Search ..... 198/321, 324, 851, 853, 198/793, 345; 104/20, 21, 25

[56] References Cited

U.S. PATENT DOCUMENTS

| | | | |
|---|---|---|---|
| 474,657 | 5/1892 | Hollingsworth | 104/21 |
| 780,268 | 1/1905 | Curtiss | 104/21 |
| 786,117 | 3/1905 | Hagen | 104/25 |
| 896,098 | 8/1908 | Gale | 198/324 |
| 1,361,583 | 12/1920 | Hiss et al. | 104/25 |
| 1,437,550 | 12/1922 | Putnam | 104/25 |
| 1,597,959 | 8/1926 | Edwards | 104/21 |
| 3,727,558 | 4/1973 | Winkle | 104/21 |
| 3,934,515 | 1/1976 | Cushman | 104/25 |
| 4,093,066 | 6/1978 | Mitchell | 198/861 |
| 4,371,075 | 2/1983 | Erlichman | 198/345 |

FOREIGN PATENT DOCUMENTS

| | | | |
|---|---|---|---|
| 2255222 | 5/1974 | Fed. Rep. of Germany | 198/321 |

*Primary Examiner*—Joseph E. Valenza
*Attorney, Agent, or Firm*—Michael P. Breston

[57] ABSTRACT

The novel mass transit system comprises at least two stations, each having a rotatable platform. An endless stationary track loops around the rotary platforms. A plurality of small cars form an endless tensioned train for moving over the track. Each car is driven exclusively by frictional forces developed between the driving platform and the cars. These frictional forces result from direct mechanical engagement between the tensioned endless train and the platforms when the cars are at the stations.

6 Claims, 5 Drawing Sheets

FRICTION-PROPELLED MASS TRANSIT SYSTEM

This application is a continuation-in-part of application Ser. No. 661,427 filed 10-16-1984 now abandoned.

BACKGROUND OF THE INVENTION

1. Field Of The Invention

This invention relates to a mass transit system which can carry through a pipeline persons, goods or materials from one covered station to another, and which is especially adapted to serve as a people mover that allows access to a vehicle or car inside the station at any time. The cars form an endless train which moves under tension non-stop at a constant speed through the pipeline as well as through the stations.

2. Description Of The Prior Art

Existing discontinuous transport systems of public conveyance, such as railroad trains, streetcars, monorails, subways, automobiles, etc., provide a mode of transportation which is characterized by "stop-and-go" displacements that use up a substantial portion of the total travel time, and are very expensive to operate. Suggestions have already been made to deal with this serious problem facing our big cities.

The following U.S. patents are illustrative of relevant prior art:

4,221,170,
4,102,272,
3,952,666,
3,727,558,
3,552,321,
3,339,494,
817,156,
780,268,
474,657.

The most pertinent reference is believed to be U.S. Pat. No. 3,865,041 to Bacon who shows boats which are detached from each other and are propelled by a rotatable platform at a passenger loading station but elsewhere they move independently of each other and are self propelled. His single passenger loading station comprises the platform which is rotatable about a fixed axis and has a driving convex cylindrical wall around its outside circumferential edge which is covered with a rubber bumper. A waterway loops around a portion of this convex wall, and has straight portions leading away from and toward the circular platform. The boats are only forcibly urged against the convex wall. The exclusive means for so urging the boats into frictional engagement with the rotating platform is an outer circular wall 45. When so pushed against the platform, the boats and the platform's outer circumferential edge will move with zero relative linear velocity therebetween. To avoid the need for such an outer wall 45 as in Bacon, it has been suggested to utilize sprocket type drives, which are cumbersome, bulky and heavy. They employ too many moving and complex parts and therefore are too expensive to manufacture and maintain. But, the chief problem with them lies in the fact that the sprockets stretch and as a result require complex synchronizing systems for obtaining true zero relative velocity between the rotatable platform and the cars.

In accordance with this invention, the propulsion for the chain of cars is automatically synchronized with the propulsion of at least two revolving platforms, so that there is no relative velocity therebetween. This is accomplished without any outside agencies, such as electronic speed synchronizing networks, or an outer wall such as that of Bacon. The invention requires no drive sprockets. It uses a tensioned endless train of very small cars in order to produce the required forces between the train and the platform so that frictional forces can be developed and transferred directly to the train from the platform. The generated platform-to-car forces are primarily normal with resulting shear driving forces developed between each car and the platform. It thus relies exclusively on tension within the endless train to generate the transfer of propulsion energy from the platform to the train.

SUMMARY OF THE INVENTION

Broadly, the novel mass transit system comprises at least two stations, each having a rotatable platform. An endless stationary track loops around the rotary platforms. A plurality of hingedly-connected small cars form an endless tensioned train for moving over the track in a closed loop circuit around the platforms. Each car is driven exclusively by frictional forces developed between the driving platform and the car. These frictional forces result from direct mechanical engagement between the tensioned endless train and the platforms when the cars are at the stations.

In one embodiment of the invention, a dome-shaped roof protects each station from the weather. Each station comprises a rotatable platform that has a center hole, an outer circular edge, and an outer cylindrical convex driving outer wall. A vertical, large-diameter casing extends downwardly through the center hole of the platform. A spiraling ramp is mounted inside the casing. The platform, casing, and ramp are secured to each other and form a single revolving unit. An endless, stationary, flat track loops around the two rotary platforms. The track is inside a large-diameter transparent pipeline which has straight and curved portions. The track is made up of a block at the bottom of the pipeline. The small cars are hingedly interconnected to form an endless, closed-loop train constantly under tension. Each car has a flat, light-weight sled which moves over the track. Each sled has an inner concave driven wall. The revolving platforms frictionally engage and exclusively drive the cars. Pivot means can be provided for hingedly connecting the cars and to carry a roller that loosely rides in a longitudinal channel which extends throughout the entire length of the track. The pivot axes of the pivot means are proximate the inner concave walls of the sleds.

The roof, the pipeline, and the train automatically establish an airflow pattern in the system for additional passenger comfort.

DETAILED DESCRIPTION OF PREFERRED EMBODIMENTS

Figure 1:
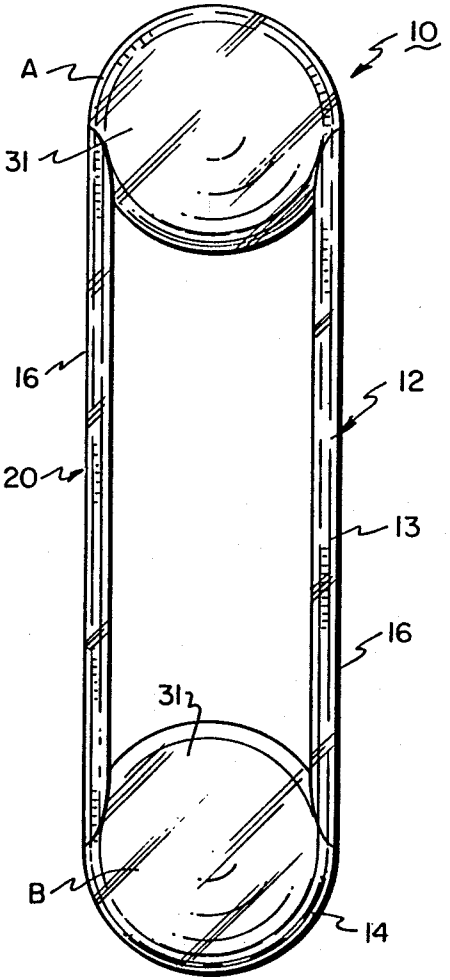
FIG. 1 is a top view of the novel mass transit system showing two stations which are interconnected by a stationary, endless track forming a closed-loop circuit.

In the description and in the drawings, the same reference characters will be used whenever possible to designate the same or similar parts to facilitate the understanding of the invention. Similar parts will not be described to avoid repetition.

Figure 4:
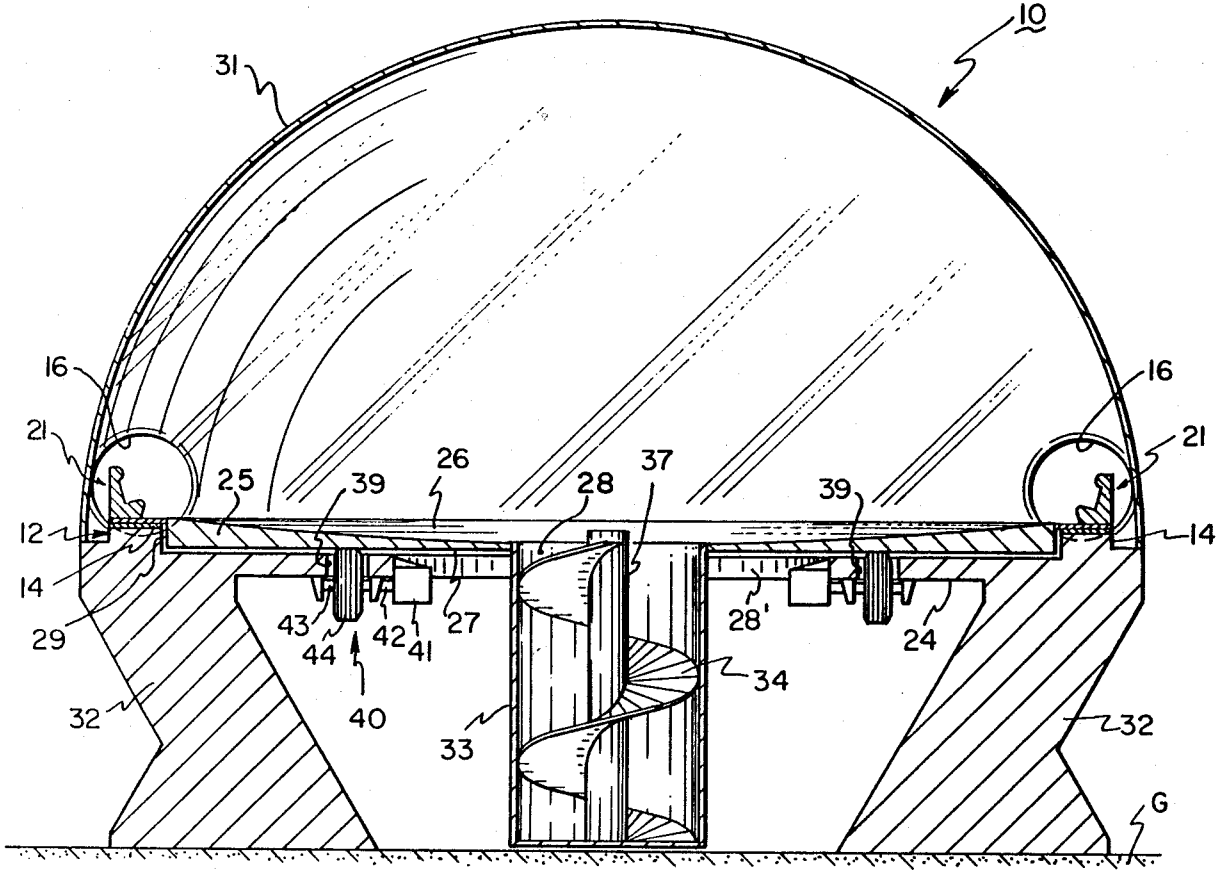
FIG. 4 is a vertical sectional view of the station taken along line 4—4 in FIG. 3.

With general reference to the drawings there is shown one embodiment of the novel mass transit system, generally designated as 10 (FIGS. 1 and 4), capable of cargo and passenger transport.

Figure 10:
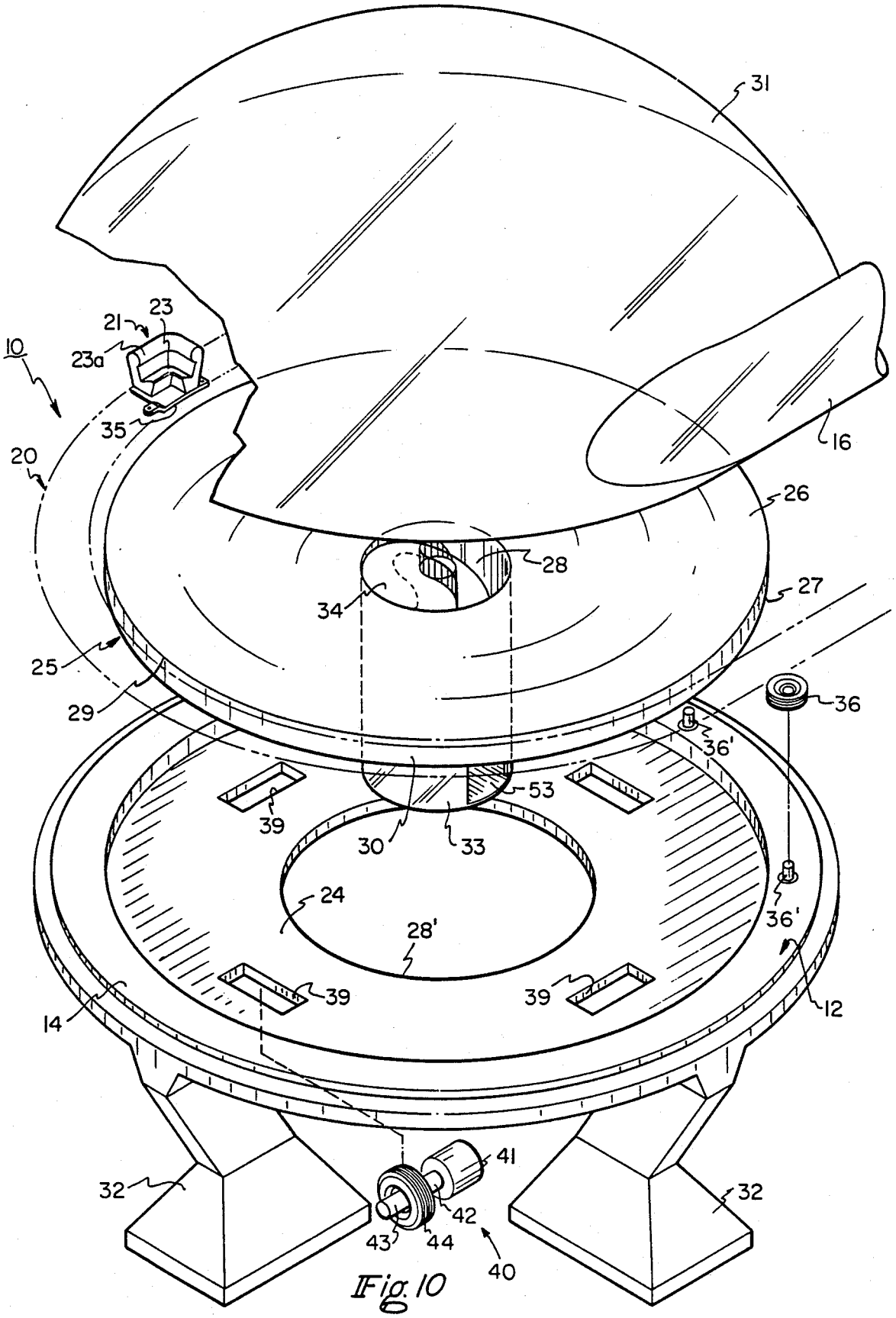
FIG. 10 is an exploded view of the major components of the station shown in FIG. 3.

System 10 preferably has two identical rotary stations A and B for receiving passenger-carrying cars 21. Each passenger-loading station A or B comprises a pillar base 32 which is unitary with a flat, stationary, circular deck 24 that supports a circular platform 25 (FIGS. 4, 10) which is rotatable about its fixed center axis. Platforms 25 in both stations A and B are identical.

Figure 2:
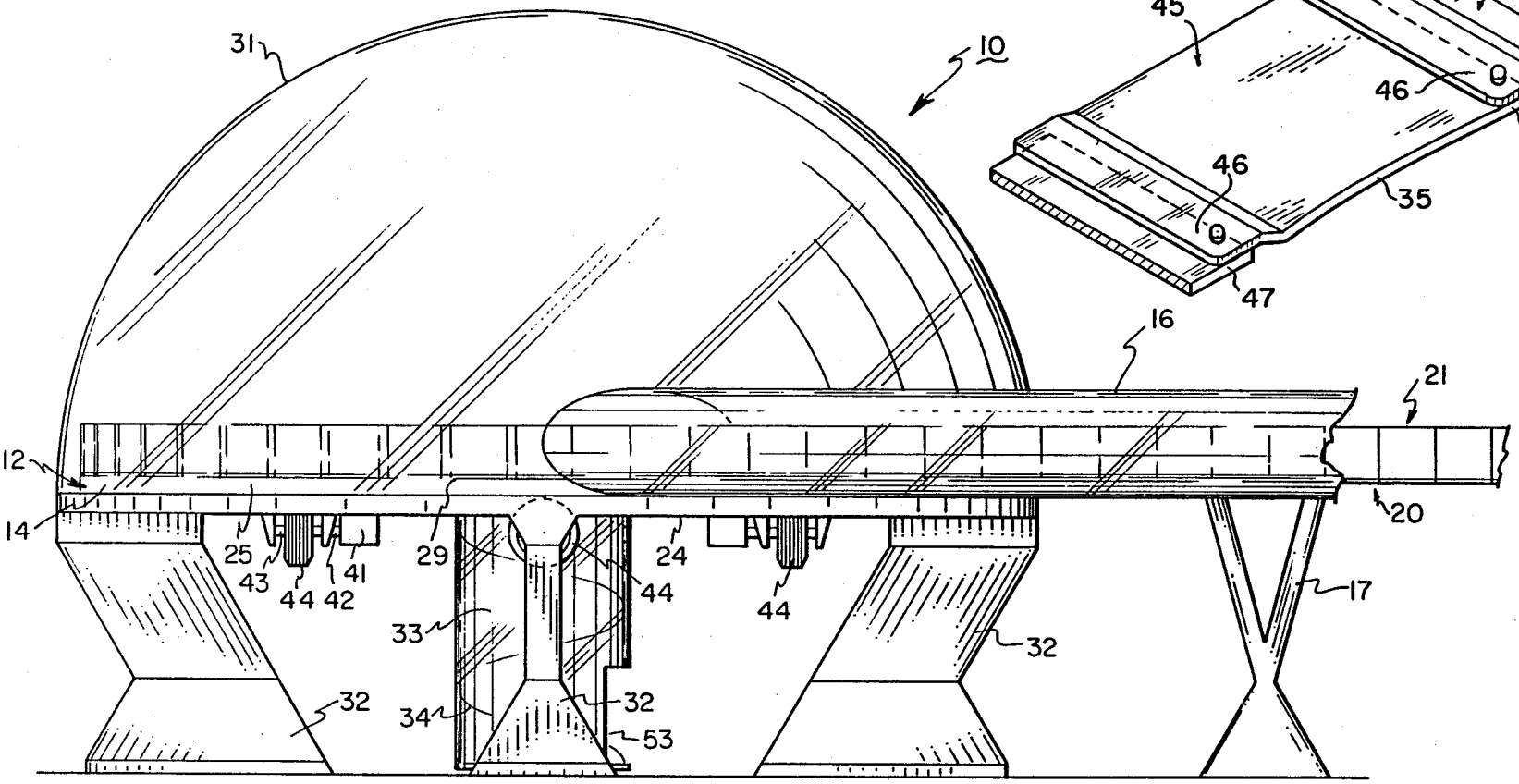
FIG. 2 is a front view of a single station and of the track around the station.
Figures 3, 6:
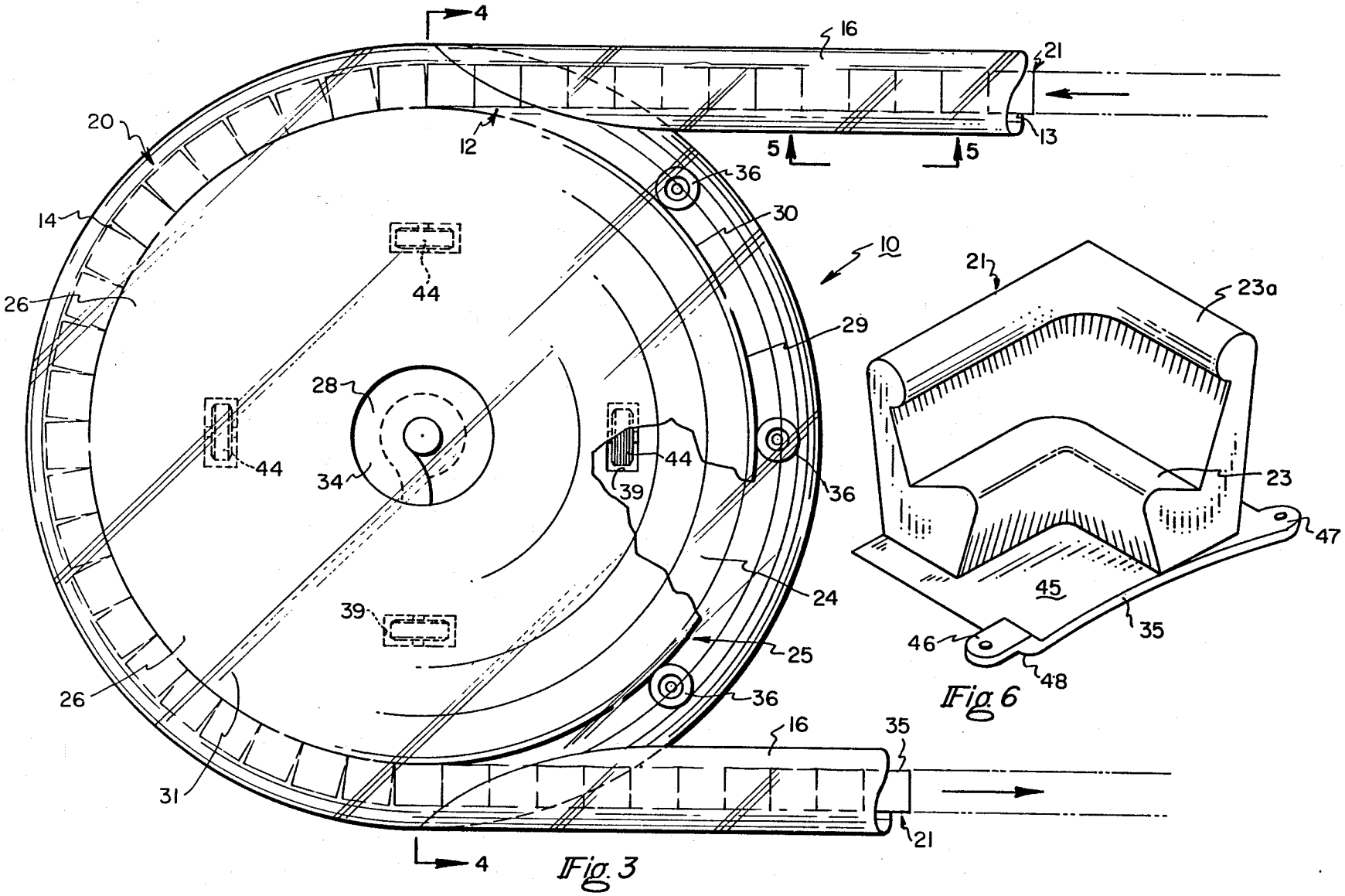
FIG. 3 is a top view of the station shown in FIG. 2.
FIG. 6 is an isometric view of a single car in the endless train.

Platform 25 has a dish-shaped top surface 26, an under surface 27, a center hole 28, an outer circular edge 29 (FIG. 2), and an outer rigid, smooth, cylindrical, convex wall 30 (FIG. 3) adapted to make frictional contact with and thereby transfer power to each car 21 when it reaches and contacts the platform.

The diameter of platform 25 and the concavity of its dish-shaped surface 26 are determined by the desired speed for its outer circumferential edge 29.

A propulsion means 40 (FIG. 10) rotates platform 25 and includes an electric motor 41 whose shaft 42 drives an axle 43 on which is mounted a rubber-tire drive wheel 44 which makes frictional contact with undersurface 27 through opening 39 in deck 24.

The rotations of platforms 25 of both stations A and B can be synchronized to a parameter of a common power source, such as frequency or phase. Platforms 25 will rotate simultaneously in the same direction and at exactly the same speed.

An endless, stationary, flat track 12 (FIG. 1) loops around the two rotary stations A and B, as shown. Track 12 has, in plan view, circular path segments 14, each positioned around a platform's circumferential edge 29, and straight track segments 13.

Figure 7:
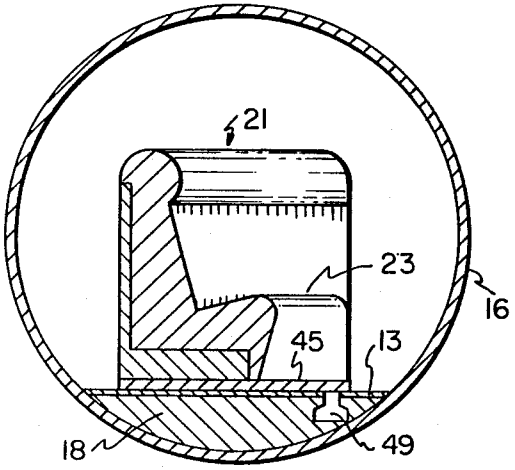

While track 12 can be exposed to the outside, it will have a longer useful life if it is under cover. Track 12 is preferably made up of a block 18 (FIGS. 7,8) disposed at the bottom of a large-diameter transparent pipeline 16, which may be supported by spaced towers 17 (FIG. 2) over sidewalks, esplanades, freeway medians, etc.

Transparent pipeline 16 will take full advantage of sunlight, moonlight, and street light. The right-of-way needed for such an elevated train 20 can be utilized efficiently and with great flexibility.

Pipeline 16 is preferably cylindrical to give it a minimum weight-to-length ratio. Block 18 can be covered with a smooth top surface, such as a teflon coating 13' or the like. Hingedly-interconnected, passenger-carrying cars 21 (FIGS. 3 and 5–9) travel over track 12 inside pipeline 16 and form an endless, closed-loop train 20.

By making endless train 20 run through pipeline 16, train 20 will encounter inside the pipeline less friction from air resistance and, hence, will consume less propulsion energy. Also, the manpower required to operate train 20 will be reduced to a minimum. No computers are required to control the travel of train 20, and hence no computer breakdowns either.

Pipeline 16 will also help to automatically create an air stream, i.e., air will be entrained by the cars as they continuously move inside the pipeline. This air stream will add to the comfort of the passengers. The clearances between the cars, the seats, and the pipeline's inner wall can be made such that a proper ratio of train speed to air speed can be established. It is desired for the air to have near zero relative velocity with the train, in order to avoid passenger discomfort, blown hair, etc.

Figure 5:
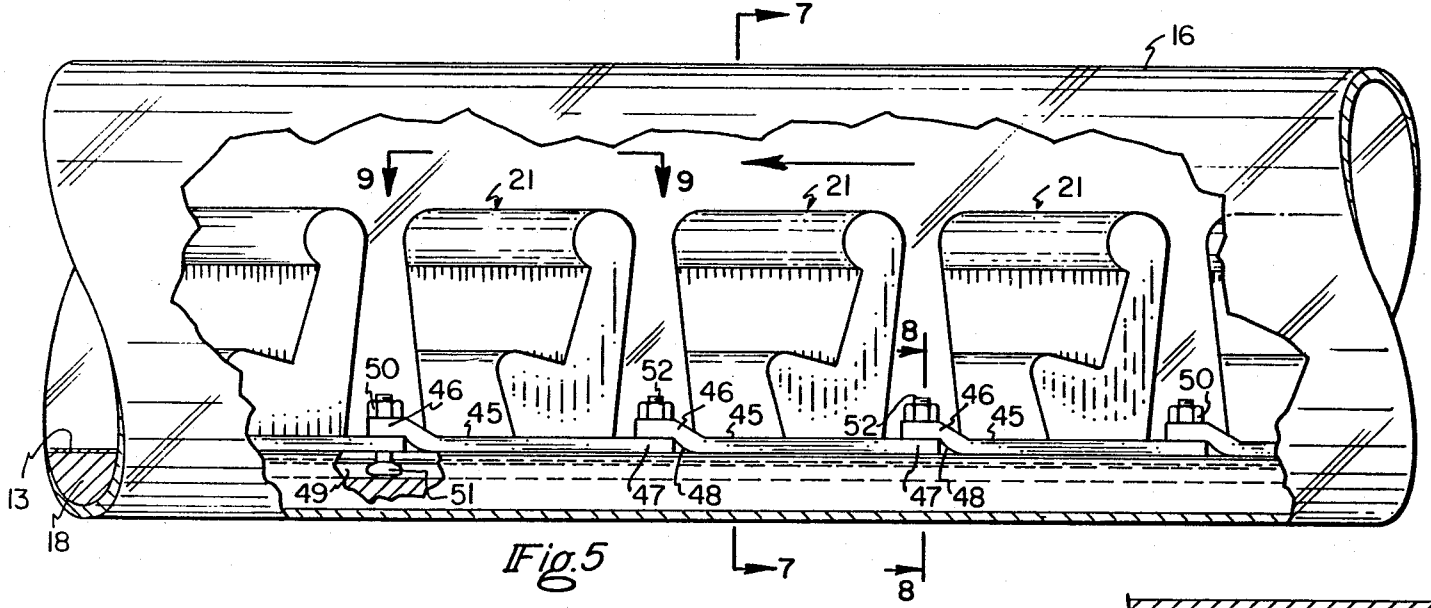
FIG. 5 is a front elevational view of a portion of the pipeline as seen from line 5—5 in FIG. 3.
Figure 9:
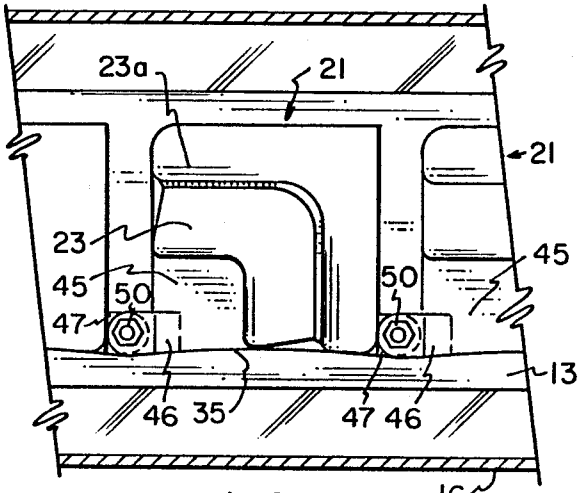
FIG. 9 is a plan view of a car taken on line 9—9 in FIG. 5.
Figure 8:
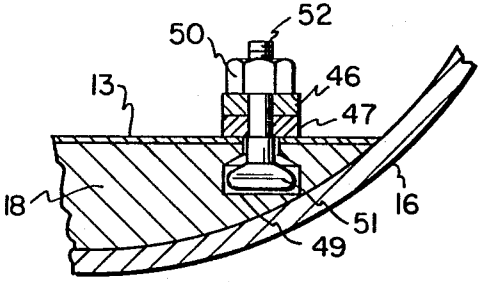
FIGS. 7 and 8 are sectional views taken respectively along lines 7—7 and 8—8 in FIG. 5.

In one embodiment, each car 21 has a flat sled 45 which slides over the smooth top surface 13' on track 12 with minimum friction. Sled 45 is light weight and preferably is slightly-curved upward on its leading edge 48 (FIGS. 5,8–9). Each sled 45 has a rigid, smooth, cylindrical, inner concave wall 30 for making frictional contact with and thereby receive power from convex wall 30 of platform 25 when it reaches the platform.

Figure 11:
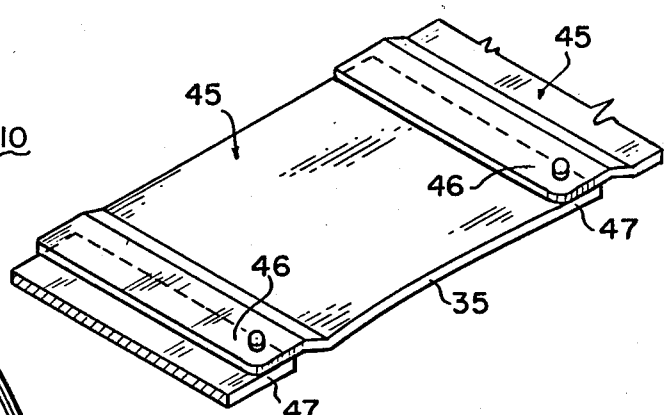
FIG. 11 is a modification of the sled showing a curved leading edge which extends across the entire width of the sled.

The end ears 46,47 of adjoining sleds 45 (FIGS. 6–9) are hingedly coupled in overlapping relation by bolts 52 and nuts 50 which are offset from the median center inwardly and positioned near concave driven wall 35. In the embodiment shown in FIG. 11, the entire front edge 46 of one sled is overlapping with the entire rear edge 47 of the following sled, but the pivot axes of bolts 52 remain proximate to wall 35.

A means for maintaining cars 21 in place against lateral forces, which may become exerted upon them, is also provided. Thus each bolt 52 has at its bottom a guide roller 51 (FIG. 8) which loosely rides in a longitudinal channel 49 that extends throughout the entire longitudinal length and inside of block 18, as shown. Rollers 51 assist in guiding sleds 45 on the track.

A curved bench 23 (FIG. 9) is installed longitudinally on sled 45. Bench 23 has a cushioned back support **23*a*. Each car 21** can be small so as to accommodate only one or a few passengers.

Convex wall 30 of platform 25 and concave wall 35 of sled 45 establish therebetween a strong, mechanical, frictional engagement, when the sled reaches the passenger loading area of the station, so that each sled 45 becomes frictionally propelled by rotary platform 25, thereby making all propelled cars 21 move exactly at the linear speed of the edges 29 of the platforms.

Train 20 must be under tension in order to permit the development of the required frictional shear driving forces between the train and the platforms, and for the frictional power to transfer from each platform 25 onto successively approaching cars 21.

The positive frictional attachment of each driven wall 35 of car 21 to the outer driving wall 30 of each platform 25 ensures at each station safe passenger boarding into each car and stepping out therefrom. Because there is no speed difference between walls 30 and 35, passengers can alight from or board a car as if both the platform and car were stationary. There is no gap nor velocity difference between walls 30 and 35 to frighten passengers away. Since there are no gaps, no dropping of personal objects into the gaps and no pinching of passengers by the gaps is possible.

Access to each platform can be accomplished, for example, by a vertical, large-diameter casing 33 (FIGS. 4,10 ) extending downwardly through the center hole 28 of platform 25 and through a larger diameter, concentric, center hole 28' on deck 24. The solid bottom of casing 33 is spaced slightly above ground G. The casing fits loosely within hole 28' and is symmetrically and centrally maintained therein by rubber-tired idle wheels 36 (FIG. 3) rotating on vertical axles 36'. An entrance 53 (FIG. 2) at the bottom of casing 33 allows passengers to move from and onto the ground level G. A simple mechanical ramp 34 is mounted inside casing 33 and spirals around a center post 37. The upper rim of casing 33 is permanently attached or welded to the rim of hole 28. Because platform 25, casing 33, and ramp 34 are secured to each other, they have no relative motion therebetween and they rotate in unison.

The revolving ramp 34 (FIGS. 2,4) takes passengers from ground level up to the level of the revolving platform 25. Thus platform 25 receives boarding as well as arriving passengers. Each boarding passenger will step from rotating ramp 34 onto the rotating platform 25; then he will continue to move outwardly in a radial direction across platform 25. In so doing, he gradually becomes accelerated until he reaches the outer edge 29 of platform 25. Conversely, when an arriving passenger leaves a car 21, he moves inwardly in a radial direction toward center hole 28 of platform 25, and thus becomes gradually decelerated from the speed of train 20 to the very low speed of ramp 34.

Accordingly, both the entry of a passenger from the top of rotatable ramp 34 onto the center of rotatable platform 25, and from an arriving train 20 unto the outer edge 29, take place with comfort, safety, and without irritation.

A dome-shaped roof 31 is provided to protect each station from the weather. Roof 31 can become also the roof for an underlying structure. The roof structure smoothly guides the air stream from an incoming pipeline section 13 into an exiting pipeline section 13, which causes the air stream to move in the same closed circuit as that of the train itself.

Because train 20 is endless, passengers can alight from and board train 20 during each revolution of platform 25. No waiting time is required, and an arriving passenger can board immediately an arriving car 21 if it is not already fully occupied. The boarding is greatly facilitated by the fact that bench 23 is longitudinally mounted on sled 45. Train 20 can travel at slower speeds than conventional trains, cars, buses, etc., and yet it can still arrive faster to its destinations. No time is lost with train 20 in making unnecessary stops, as is the case with conventional, intermittent transit systems presently being utilized. Because waiting times to board on, and multi-stops by, train 20 are eliminated, the total travel time from station A to station B will be the same as that of a bus traveling at peak speeds considerably higher than the speed of train 20.

Since train 20 continuously moves on track 12 at a constant speed, there will be no accelerations or decelerations of the train, which lead to an inefficient use of propulsion energy, and irritating jerks to passengers who prefer to read a newspaper in complete comfort.

In sum, the novel mass transit system 10 is energy efficient, light weight, compact, easy to fabricate and to repair. It lends itself to modular construction techniques and can be easily incorporated into existing structural buildings without appreciably affecting their utility. It moves passengers conveniently, comfortably, and at precisely the same linear speed as that of the outer edges 29 of rotatable platforms 25.

System 10 can operate above ground, or be at ground level. It is especially adaptable for moving passengers at fairs, exhibits, airports, and over short or long distances. It can be well integrated with existing moving walkways and ramps to minimize the walking distances for passengers to and from the stations. System 10 makes optimum use of established right-of-ways without requiring substantial modifications thereto, thereby minimizing the need to acquire new and very costly right-of ways.

The cost of constructing and operating system 10 will be a fraction of the cost involved in constructing either a conventional intermittent transport system, or any one of the continuous transport systems that were already proposed in the patent literature.

What is claim is:

1. A mass transit system, comprising:

at least two stations, each including a circular platform having an outer convex driving wall;

propulsion means for rotating said platforms about their center axes;

a stationary track looping around said rotary platforms;

a plurality of hingedly-connected cars forming an endless tensioned train for moving over said track in a closed loop circuit around said platforms;

said cars being driven exclusively by frictional forces resulting from direct mechanical engagement between the tensioned endless train and said convex driving walls of said platforms when the train reaches each station; and the axis about which each car pivots is proximate to the car's driven wall.

2. A mass transit system, comprising:

at least two stations, each including a circular platform having an outer convex driving wall;

propulsion means for rotating said platforms about their center axes;

a stationary track looping around said rotary platforms;

a plurality of hingedly-connected cars forming an endless tensioned train for moving over said track in a closed loop circuit around said platforms;

said cars being driven exclusively by frictional forces resulting from direct mechanical engagement between the tensioned endless train and said convex driving walls of said platforms when the train reaches each station, and the axis about which each car pivots is proximate to the car's driven wall; and a pipeline for housing said track, and said endless train moving over said track inside said pipeline.

3. A mass transit system, comprising:

at least two stations, each including a circular platform having an outer convex driving wall;

propulsion means for rotating said platforms about their center axes;

a stationary track looping around said rotary platforms;

a plurality of hingedly-connected cars forming an endless tensioned train for moving over said track in a closed loop circuit around said platforms;

said cars being driven exclusively by frictional forces resulting from direct mechanical engagement between the tensioned endless train and said convex driving walls of said platforms when the train reaches each station, and the axis about which each car pivots is proximate to the car's driven wall;

a pipeline for housing said track, and said endless train moving over said track in said pipeline; and a roof over each station communicating with said pipeline to allow air to move within said system throughout its entire track, due to the entrainment of the confined air within the pipeline by the moving chain of cars.

4. A transit system, comprising: at least two rotary stations; each station including a deck having a center hole; a platform supported by the deck, the platform having a center hole and a cylindrical outer driving wall; a vertical, large-diameter casing extending downwardly through the center holes of said platform and of said deck; the casing fitting loosely within the hole in the deck, and said platform being symmetrically and centrally maintained therein by idle wheels mounted on vertical axles, and said idle wheels engaging said outer driving wall; the bottom of the casing being spaced above ground, and the casing having an entrance near the bottom of the casing through which passengers can move in from the ground level;

a spiraling ramp mounted inside the casing; the platform, casing, and ramp being secured to each other so as to rotate in unison; an entrance in the casing to allow passengers to move into and out of the casing; an endless, stationary, flat track looping around the two rotary stations;

a large-diameter pipeline, said flat track being inside and at the bottom of said pipeline;

a roof over each station communicating with said pipeline to allow air to move within said system throughout its entire track, due to the entrainment of the air confined within the pipeline by the moving chain of cars;

a plurality of hingedly-connected cars forming an endless chain of cars for moving under tension over the track;

each car having an arcuate driven wall for frictionally engaging consecutive portions of said driving wall of said platform when in contact therewith at each station; and propulsion means to rotate each platform thereby to propel said cars exclusively by frictional engagement which results from direct contact forces between the tensioned endless train and said platforms.

5. The system according to claim 4, and a bench disposed longitudinally on each sled.

6. A mass transit system, comprising: at least two rotary stations; each station comprising a flat circular deck, a platform supported by said deck, said platform having a top surface, a bottom hub undersurface, a center hole, an outer circular edge, and a circumferential cylindrical driving outer wall; a vertical, large-diameter casing extending downwardly through the center hole of the platform and through a concentric center hole of the deck, the casing fitting loosely within the hole in the deck and being symmetrically and centrally maintained therein, the bottom of the casing being spaced slightly above ground and through an entrance near the bottom of the casing passengers can move into the casing and out of the casing from the ground level; a spiraling ramp mounted inside the casing; said platform, casing, and ramp forming a single revolving unit;

a large-diameter pipeline;

an endless, stationary, flat track looping around the two rotary stations, the track being inside said pipeline and being made up of a block at the bottom of the pipeline;

a plurality of cars forming an endless tensioned train, each car having a flat, light-weight sled which slides over the track; the sled having a concave driven wall; the adjacent ends of each pair of cars being pivotably coupled in overlapping relation by pivot means which also carry a roller that loosely rides in a longitudinal channel which extends throughout the entire length of said block and below the surface of the flat track; the pivot axes of the pivot means being closely spaced to the driven walls of the sleds;

each arcuate driven wall frictionally engaging consecutive portions of said driving wall of said platform when in contact therewith at each station;

said cars being driven exclusively by said frictional engagement which results from normal contact forces between the tensioned endless chain of cars and said circumferential driving walls, thereby causing said driving walls to propel the driven walls of the contacting cars, which permits passenger transfer between said cars and said platform during a condition of zero relative motion therebetween; and drive means for rotating said platforms and thereby propelling said train.

* * * * *